US010254084B2

(12) United States Patent
Connolly et al.

(10) Patent No.: US 10,254,084 B2
(45) Date of Patent: Apr. 9, 2019

(54) CO-ALIGNED CLOSE QUARTERS BATTLEFIELD SIGHT

(71) Applicant: Raytheon Canada Limited, Ottawa (CA)

(72) Inventors: John M. Connolly, Penetanguishene (CA); Geoff Harris, Midland (CA); Brien Ross, Wyevale (CA)

(73) Assignee: RAYTHEON CANADA LIMITED, Ontario (CA)

( * ) Notice: Subject to any disclaimer, the term of this patent is extended or adjusted under 35 U.S.C. 154(b) by 0 days.

(21) Appl. No.: 15/578,129

(22) PCT Filed: Jun. 2, 2015

(86) PCT No.: PCT/CA2015/050512
§ 371 (c)(1),
(2) Date: Nov. 29, 2017

(87) PCT Pub. No.: WO2016/191847
PCT Pub. Date: Dec. 8, 2016

(65) Prior Publication Data

US 2018/0156576 A1 Jun. 7, 2018

(51) Int. Cl.
*F41G 1/38* (2006.01)
*F41G 11/00* (2006.01)

(52) U.S. Cl.
CPC ..... *F41G 11/001* (2013.01); *F41G 1/38* (2013.01)

(58) Field of Classification Search
CPC ..... F41G 11/001; F41G 1/38
See application file for complete search history.

(56) References Cited

U.S. PATENT DOCUMENTS

| | | | | |
|---|---|---|---|---|
| 4,841,659 | A * | 6/1989 | Williams | F41G 1/38 42/119 |
| 5,887,375 | A | 3/1999 | Watson | |
| 6,327,806 | B1 * | 12/2001 | Paige | F41G 1/30 42/113 |
| 7,752,798 | B2 | 7/2010 | Mayerle | |
| 7,765,731 | B1 * | 8/2010 | Liebig | F41G 1/01 42/113 |
| 7,957,072 | B2 * | 6/2011 | Rozitis | G02B 23/10 359/694 |
| 7,982,858 | B2 | 7/2011 | Holmberg | |
| 8,151,509 | B2 * | 4/2012 | Rozitis | F41G 11/003 42/125 |

(Continued)

OTHER PUBLICATIONS

"Long-Range & Short-Range Hunting Scope Combo Setup", www.precisionrifleblog.com, Mar. 7, 2013 (Year: 2013).*

(Continued)

*Primary Examiner* — Joshua T Semick
(74) *Attorney, Agent, or Firm* — Cantor Colburn LLP

(57) ABSTRACT

A close quarters battlefield (CQB) sight is provided. The CQB sight includes an optical sighting element and a base plate to which the optical sighting element is integrally coupled. The base plate includes a flange and a mounting surface formed to complement a mounting surface of another optical sighting element. The flange is configured to be fastened to the another optical sighting element such that the mounting surfaces abut and the optical sighting elements become co-aligned.

17 Claims, 9 Drawing Sheets

(56) References Cited

U.S. PATENT DOCUMENTS

| | | | | |
|---|---|---|---|---|
| 8,336,244 | B2 * | 12/2012 | Peterson | F41G 11/001 42/124 |
| 8,915,008 | B2 * | 12/2014 | Mauricio | F41G 1/38 42/111 |
| 9,389,046 | B2 * | 7/2016 | Cheng | F41G 1/38 |
| 9,441,915 | B2 * | 9/2016 | Zimmer | F41G 11/004 |
| 9,690,090 | B2 * | 6/2017 | Russ | G02B 23/14 |
| 2010/0077646 | A1 * | 4/2010 | Gaber | F41G 1/30 42/123 |
| 2014/0123532 | A1 * | 5/2014 | Russ | F41G 1/38 42/113 |
| 2016/0047627 | A1 * | 2/2016 | Liang | F41G 1/473 42/115 |

OTHER PUBLICATIONS

"4X Fixed Magnified Rifles/Night Vision Scope/Mini Red DOT, Standard 20mm Qd Scope Mount C11-0160 Tan", canislatrans.en.made-in-china.com (Year: 2018).*

"Savage 22 scope mount—Scope Mount / Gasket", www.haikeoutdoor.com (Year: 2018).*

ISR/WO, issued Oct 2, 2016, RAY0305PCT, PCT Application No. PCT/CA20015/050512, 7 pages.

Search Report dated Jan. 9, 2019 RAY0305EP, EP Application No. EP15893559, 7 pages.

* cited by examiner

CO-ALIGNED CLOSE QUARTERS BATTLEFIELD SIGHT

DOMESTIC BENEFIT/NATIONAL STAGE INFORMATION

The present application is a national stage application of PCT Application No. PCT/CA2015/050512, which was entitle "CO-ALIGNED CLOSE QUARTERS BATTLEFIELD SIGHT", filed on Jun. 2, 2015. The entire contents of PCT Application No. PCT/CA2015/050512 are incorporated herein by reference.

BACKGROUND

The present invention relates to a battlefield sight and, more specifically, to a co-aligned, close quarters battlefield (CQB) sight.

Currently, CQB sights require independent bore-sight alignment. Thus, general applications of CQB sights in a given system with multiple optical paths to be bore-sighted often require that independent adjustments of the CQB sights are needed whenever bore-sight correction is required. Other multi-path systems employ a common housing or orthogonal mounting interface to incorporate independent optical assemblies into a single integrated assembly that cannot be easily disassembled and which would need individual adjustment to become a co-aligned system.

SUMMARY

According to one embodiment of the present invention, a close quarters battlefield (CQB) sight is provided. The CQB sight includes an optical sighting element and a base plate to which the optical sighting element is integrally coupled. The base plate includes a flange and a mounting surface formed to complement a mounting surface of another optical sighting element. The flange is configured to be fastened to the another optical sighting element such that the mounting surfaces abut and the optical sighting elements become co-aligned.

According to another embodiment of the present invention, a sight assembly is provided. The sight assembly includes a first optical instrument comprising an optical sighting element formed to define an optical pathway and a mounting surface and a second optical instrument. The second optical instrument includes an optical sighting element formed to define an optical pathway and a base plate to which the optical sighting element of the second optical instrument is integrally coupled. The base plate includes a flange and a mounting surface formed to complement the mounting surface of the first optical instrument. The flange is configured to be fastened to the first optical instrument such that the mounting surfaces abut and the optical pathways become co-aligned.

According to another embodiment of the present invention, a method of assembling a sight assembly is provided and includes defining respective optical pathways through optical sighting elements of first and second optical instruments, coupling, to the optical sighting element of the second optical instrument, a base plate including a flange and a mounting surface formed to complement a mounting surface of the first optical instrument and fastening the flange to the first optical instrument such that the mounting surfaces abut and the optical pathways become co-aligned with each other or, respectively, with transverse target lines.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

DETAILED DESCRIPTION

As will be described below, a close combat sight is provided, for example as a close quarter battlefield (CQB) sight, and is configured to be mounted and re-mounted to an externally zeroed telescopic sight without requiring the CQB sight to be bore-sighted. The CQB sight can be assembled to the telescopic sight cost effectively and have boresight retention characteristics because the CQB sight has no moving parts for boresight correction and is assembled using fixed-in-place components and focused for best performance.

With reference now to FIGS. 1 and 2-6, a sight assembly 10 is provided for use with various items such as weaponry, sighting and range finding instruments and surveying instruments. In each case and, as will be described below, the sight assembly 10 includes multiple optical elements with at least one optical element that is innately bore-sighted to the item and at least one optical element that is innately bore-sighted to the at least one optical element innately bore-sighted to the item. For purposes of clarity and brevity, however, the following description of the sight assembly 10 will relate to the case where the sight assembly 10 is provided for use with a weapon, such as a rifle 101.

Figure 1:
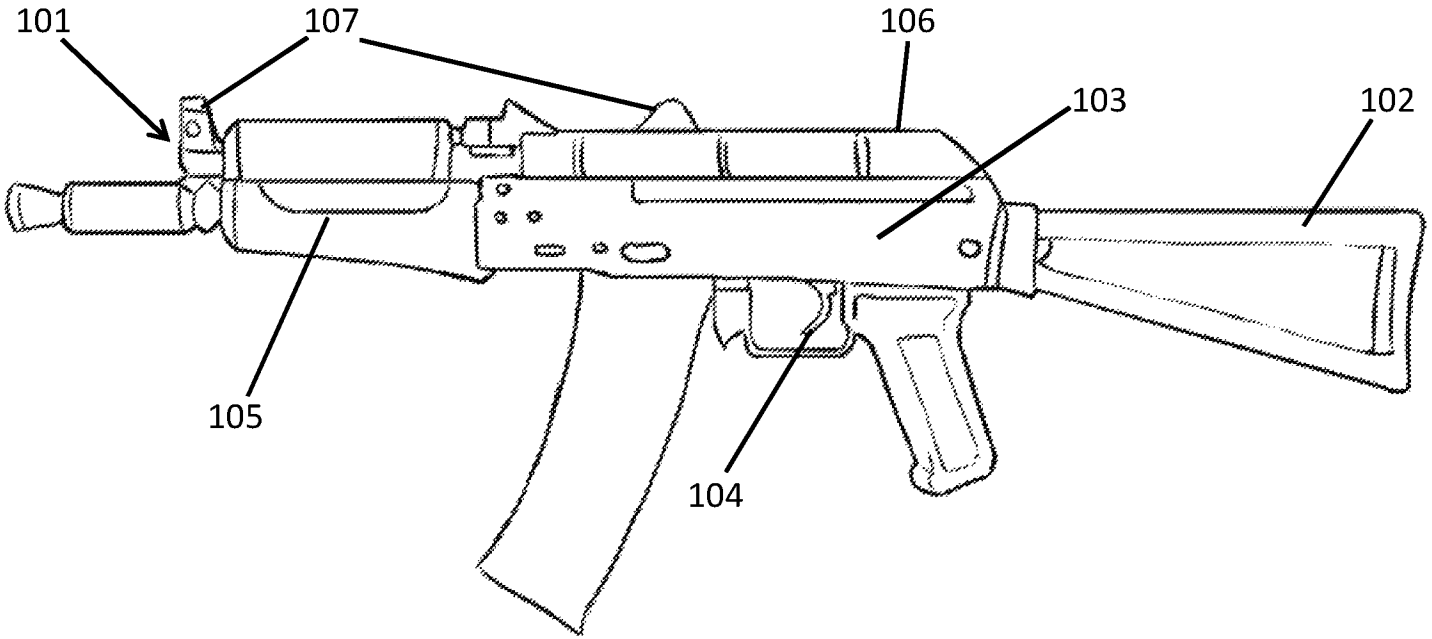
FIG. 1 is a perspective view of a rifle in accordance with embodiments.
Figure 2:
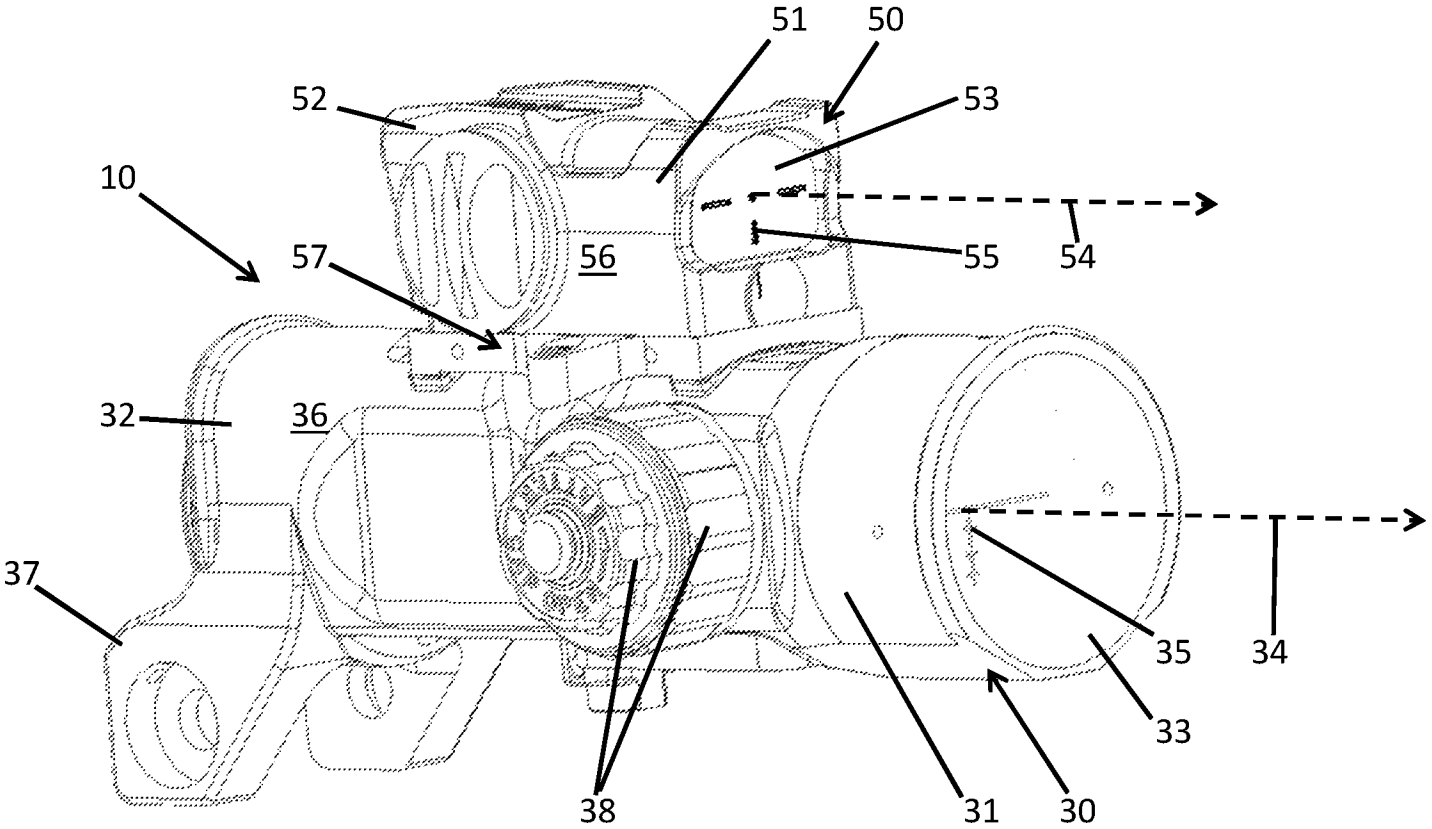
FIG. 2 is a perspective view of a sight assembly provided for use with the rifle of FIG. 1 in accordance with embodiments.
Figure 3:
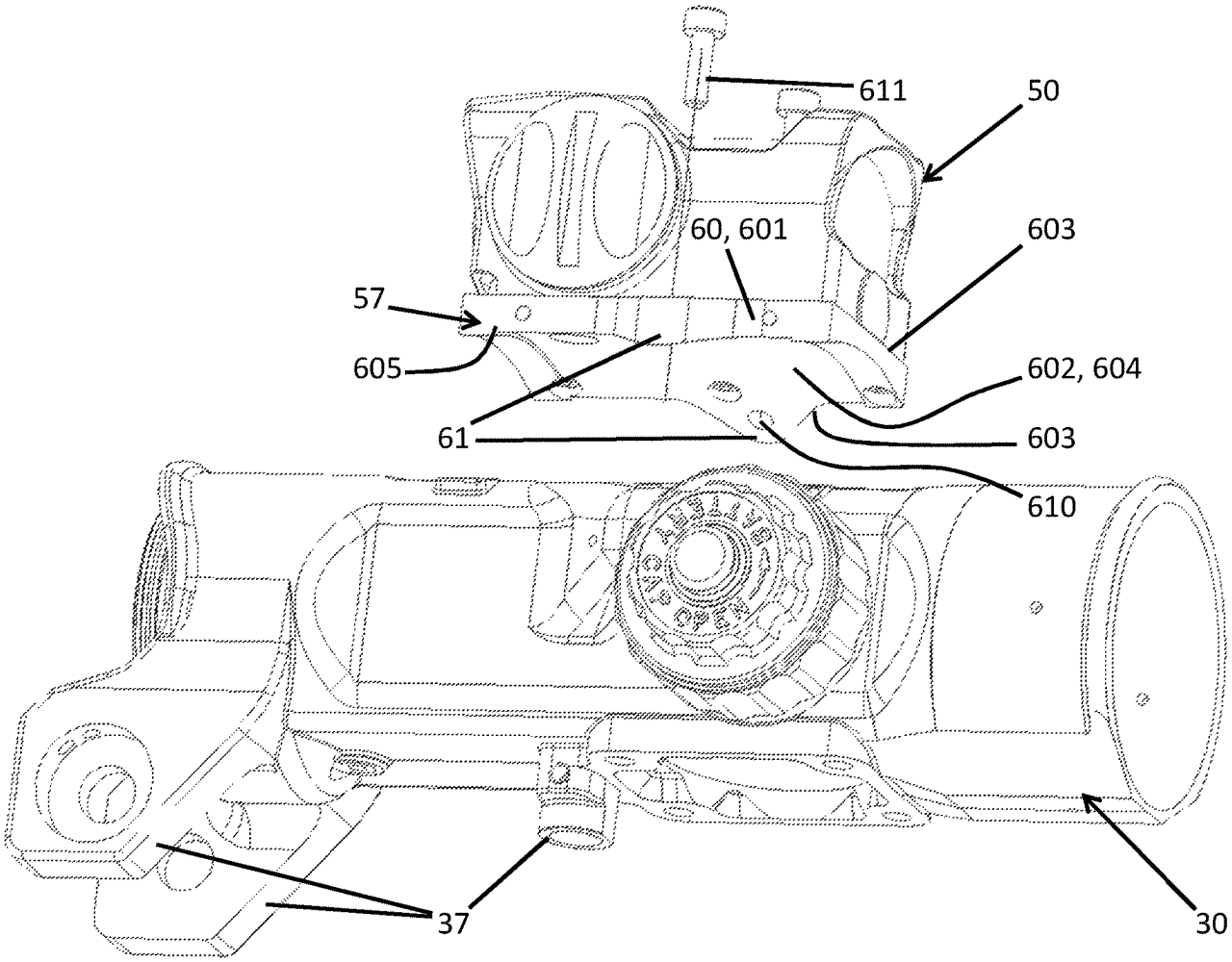
FIG. 3 is an exploded perspective view of the sight assembly of FIG. 2.
Figure 4:
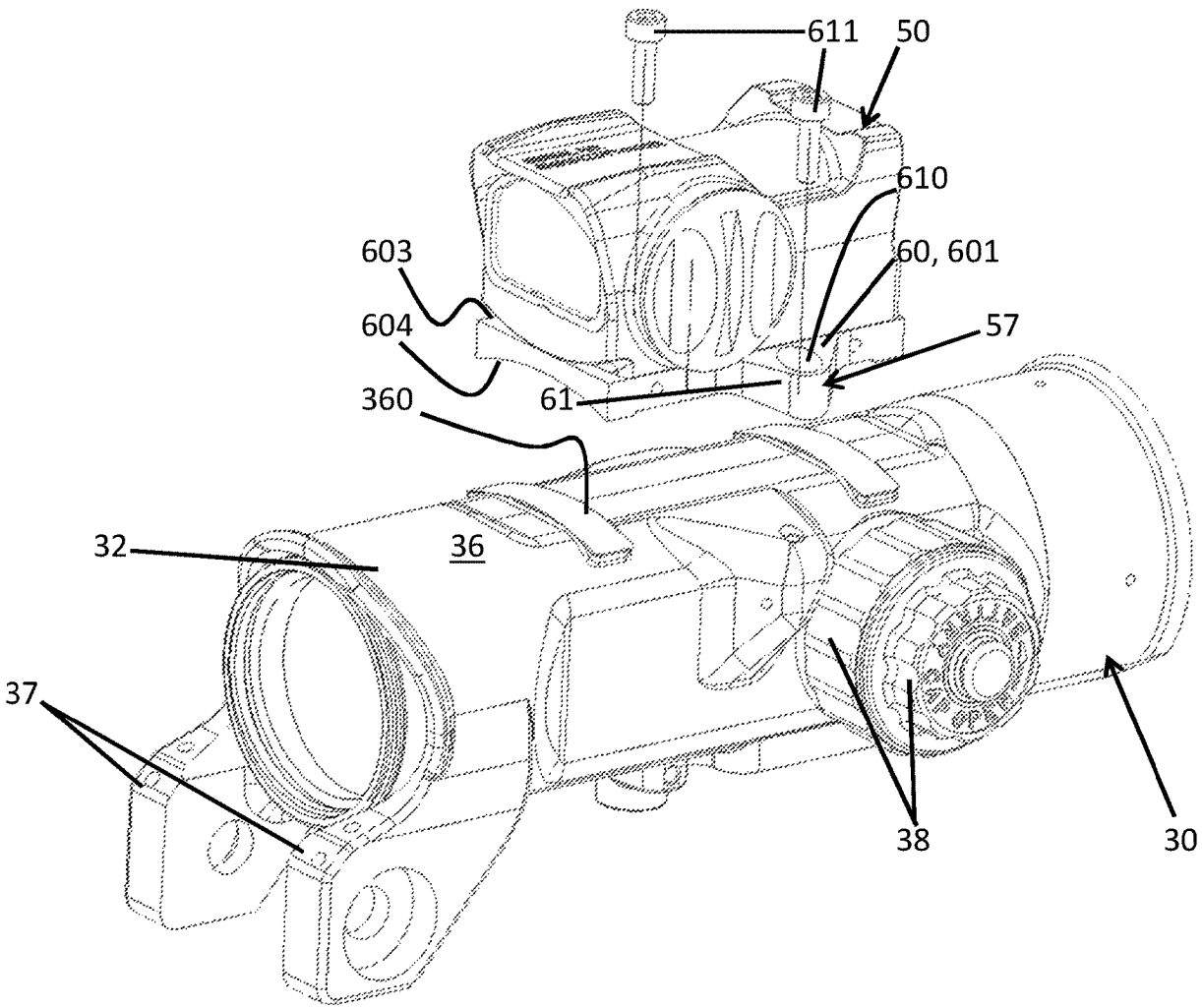
FIG. 4 is an exploded perspective view of the sight assembly of FIG. 2 from a different direction than FIG. 2.
Figure 5:
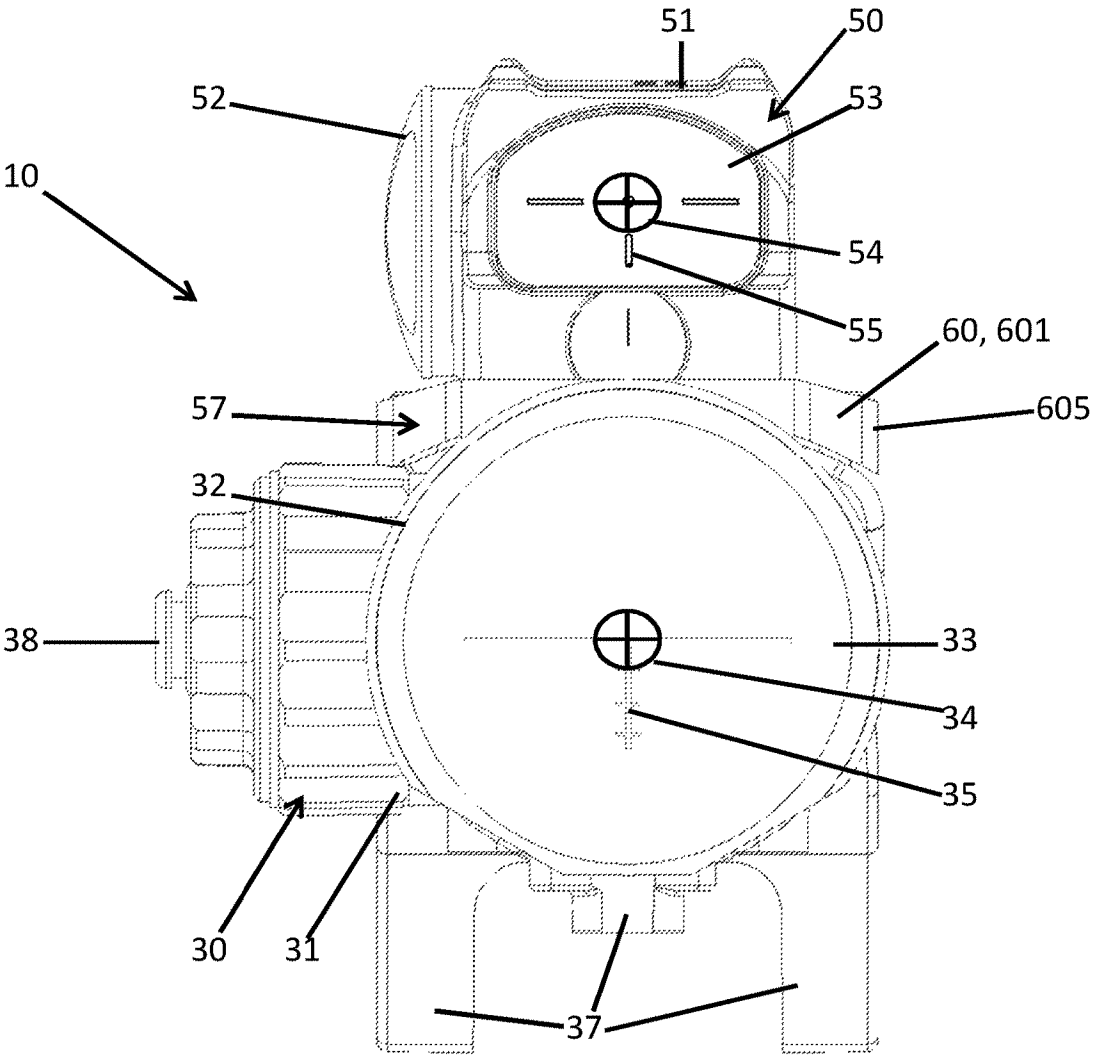
FIG. 5 is an axial view of the sight assembly of FIG. 2.
Figure 6:
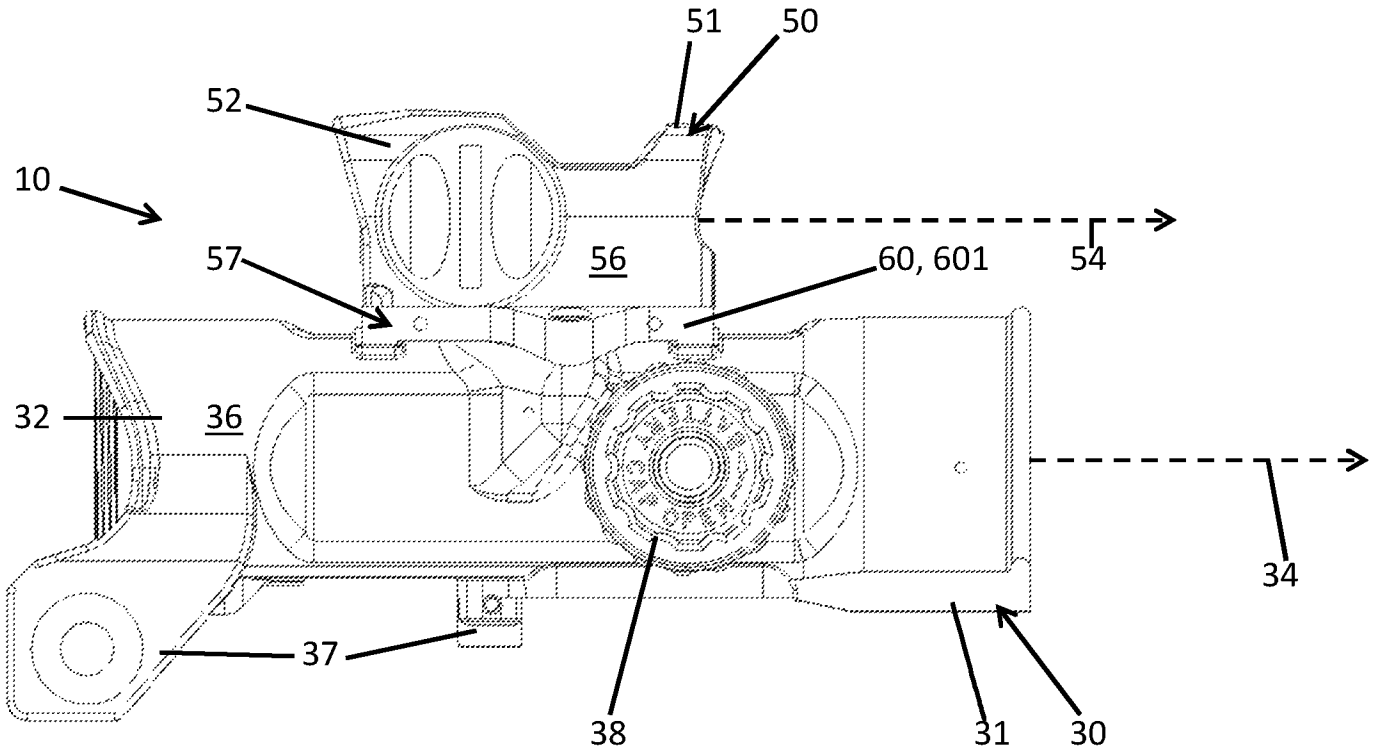
FIG. 6 is a side view of the sight assembly of FIG. 2.

As shown in FIG. 1, the rifle 101 generally includes a stock 102, a firing mechanism 103, a trigger 104 and a barrel 105. During operation of the rifle, the stock 102 is braced against the user's shoulder and extends forwardly. The barrel 105 extends forwardly from the distal end of the stock 102 and includes a proximal end, which is coupled to the stock 102, a distal end opposite the proximal end and a rifled interior through which a fired bullet travels from the proximal end toward the distal end. The firing mechanism 103 is configured to fire the bullet and is disposed at the proximal end of the barrel 105. The firing mechanism 103 is actuated by the trigger 104, which is disposed at the distal end of the stock 102. The rifle 101 further includes a top surface running along the barrel 105, a rail element 106 and bore-sights 107. The rail element 106 and the bore-sights 107 are both disposed along the top surface with the rail 106 being configured to be supportive of, for example, a telescopic sight and the bore-sights 107 arranged in sequence along the length of the barrel to aid the user in aiming the rifle 101.

The bore-sights 107 are generally provided as proximal and distal pairs of lateral protrusions that extend upwardly from the top surface of the rifle 101 with a space between them. When preparing to fire the rifle 101, the user aims by looking down the length of the barrel and through the spaces between the lateral protrusions to thereby line up the bore-sights 107 with his target. However, since the bore-sights 107 do not usually include optical elements, such as magnifying lenses or cross-hairs, the accuracy of the rifle 101 is limited to the user's skill level when the user only uses the bore-sights 107 for aiming. Thus, for distant targets, the user may choose to aim through the telescopic sight attached to the rail element 106. The telescopic sight generally includes optical elements that aid the user in aiming the rifle 101 toward distant targets that the user would otherwise be unable to hit using only the bore-sights 107.

With the telescopic sight attached to the rail element 106, the telescopic sight itself and/or its mountings often block the user's view through the bore-sights 107. As such, it becomes difficult for the user to aim the rifle 101 at nearby targets when the telescopic sight is in use. This issue often occurs during CQB instances where the user needs to be able to fire at both nearby and distant targets but has little time to adjust, replace or remove the telescopic sight between targeting or firing procedures.

With the issue described above in mind, the sight assembly 10 includes a first optical instrument 30 and a second optical instrument 50.

The first optical instrument 30 may include, for example, a telescopic sight element 31 for use with the rifle 101 of FIG. 1. To this end, the telescopic sight element 31 includes a first frame 32 and a first optical sighting element 33. The first optical sighting element 33 may include forward and aft lenses that cooperatively define a first optical pathway 34 and serve to magnify a distant target for a user looking through the aft and then the forward lenses along the first optical pathway 34. The first optical sighting element 33 may further include a reticle (or cross-hairs) 35, which can be imprinted on, embedded in or projected onto the aft and forward lenses to aid the user during the aiming process. The first optical sighting element 33 may also include circuitry and additional optical features that are configured to generate additional computer generated imagery for the user during the aiming process or to enhance an image seen through the first optical sighting element 33.

The first frame 32 is generally configured to support the first optical element 33 and includes a first frame body 36, mounting features 37 and bore-sighting devices 38. The mounting features 37 are disposed to be attachable to the rail element 106 of the rifle 101 and the first frame body 36 is generally but not necessarily provided as a cylindrical body configured to support the aft and forward lenses at corresponding aft and forward locations along the first frame body 36. The first frame body 36 includes a mounting surface 360 (see FIG. 4) at an upper portion thereof and will be discussed in greater detail below. The bore-sighting devices 38 can be manipulated by the user once the mounting features 37 are fully attached to the rail element 106 in order to align the first optical pathway 34 with the alignment of the bore-sights 107.

Where the first frame body 36 is provided as a cylindrical body, the mounting surface 360 is provided as a section of the cylindrical body and thus extends along the longitudinal axis of the frame body 36 with a convex shape or an upward and outward curvature that is aligned with the longitudinal axis. It is to be understood, however, that the mounting surface 360 can be aligned with the longitudinal axis of the first frame body 36 regardless of the shape of either element. In any case, once the mounting features 37 are fully attached to the rail element 106 and the bore-sighting devices 38 are manipulated by the user in order to align the first optical pathway 34 with the alignment of the bore-sights 107, the longitudinal axis of the frame body 36 and the mounting surface 360 become aligned with the first optical pathway 34 and the alignment of the bore-sights 107. In this condition, the first optical instrument 30 is regarded as being bore-sighted with respect to the rifle 101.

The second optical instrument 50 may include, for example, a sight element 51 that may or may not be telescopic. To this end, the sight element 51 includes a second frame 52 and a second optical sighting element 53. The second optical sighting element 53 may, but is not required to, include forward and aft eye-pieces or lenses. In either case, the second optical sighting element 53 is formed to define a second optical pathway 54. In accordance with embodiments, the second optical pathway 54 has a different range as compared to the first optical pathway 34 and may, in some cases, have an effective range that is similar to that of the bore-sights 107. Thus, with the second optical instrument 50 attached to the first optical instrument 30, as described below, and the first optical instrument 30 attached to the rifle 101, the second optical instrument 50 may be usable for aiming the rifle 101 during CQB instances without requiring adjustment, replacement or removal of the first optical instrument 30.

The second optical sighting element 53 may further include a reticle (or cross-hairs) 55, which can be imprinted on, embedded in or projected onto the aft and forward eye-pieces or lenses to aid the user during the aiming process. The second optical sighting element 53 may also include circuitry and additional optical features that are configured to generate additional computer generated imagery for the user during the aiming process or to enhance an image seen through the first optical sighting element 53.

The second frame 52 is generally configured to support the second optical element 53 and includes at least a second frame body 56 and mounting features 57. The mounting features 57 will be described in greater detail below and are disposed to be attachable to first frame body 36 and the mounting surface 360 of the first optical instrument 30. The second frame body 56 is generally but not necessarily provided as a cylindrical body configured to support the aft and forward eye-pieces or lenses at corresponding aft and forward locations along the second frame body 56.

The mounting features 57 may be provided as a base plate 60 to which the second optical sighting element 53 of the second optical instrument 50 is integrally coupled and one or more flanges 61. The base plate 60 includes a base plate body 601 that has a first surface 602, a second surface 603 opposite the first surface 602 and first and second opposite lateral sides 605. The first surface 602 may be provided as a mounting surface 604 that is disposed and configured to abut with and be mounted onto the mounting surface 360. The second optical sighting element 53 is disposable on the second surface 603 and thus the second surface 603 is formed with a shape that complements a shape of a lower portion of the second frame body 56. In accordance with embodiments, the second surface 603 may be planar or substantially flat.

The mounting surface 604 is formed with a shape that complements the shape of the mounting surface 360. Thus, where the mounting surface 360 is a section of a cylindrical body with a convex shape or an upward and outward curvature, the mounting surface 604 has a correspondingly sectioned-cylindrical or concave shape with an upward and inward curvature. In any case, by virtue of the disposition of the second optical sighting element 53 on the second surface 602, the mounting surface 604 is aligned with a longitudinal axis of the second optical sighting element 53 and the second optical pathway 54.

The one or more flanges 61 are provided at one or both of the first and second opposite lateral sides 605 and are integrally formed with the base plate 60. In accordance with embodiments, the flanges 61 may be provided as lateral and transverse curved protrusions that extend laterally outwardly from the lateral sides 605 to thereby extend a reach of the mounting surface 604. In any case, the flanges 61 are formed to define through-hole features 610, which correspond in position to corresponding fastening features on the first frame body 36. At least one or both of the through-hole features 610 and the corresponding fastening features may be threaded such that they can engage with threading of a fastening element (i.e., a screw 611). Therefore, the flanges 61 are configured to be fastened to the first frame body 36 of the first optical instrument 30 such that the mounting surface 604 can be drawn toward and brought into abutting contact with the mounting surface 360 and such that the first and second optical pathways 34 and 54 become co-aligned.

With the configurations described above, the second optical instrument 50 provides for CQB sighting of the rifle 101 even as the first optical instrument 30 is attached to the rail element 106. Once the first optical instrument 30 is fully attached and bore-sighted, the abutment of the mounting surface 604 with the mounting surface 360 as a result of the fastening of the flanges 61 to the first frame body 36 brings the first and second optical pathways 34 and 54 into co-alignment with little to no additional modifications or individual alignments. Moreover, in accordance with embodiments, the second optical instrument 50 may be provided as a plurality of second optical instruments 50. As such, if a single one of the second optical instruments 50 is installed as part of the sight assembly 10 and subsequently damaged, a substitute second optical instrument 50 can replace it. This substation can be done with little to no additional modifications or individual alignments.

In accordance with further embodiments, the various components of the first and second frame bodies 36 and 56 may be substantially rigid such that, once the various attachments and fastenings are made, the co-alignment of the first and second optical pathways 34 and 54 remains in effect. However, it is to be understood that additional or alternative features may be provided with substantially rigid or somewhat compliant characteristics. For example, it is possible that rigid or compliant interposer layers be disposed between the second optical sighting element 53 and the second surface 603 and/or between the mounting surface 604 and the mounting surface 360. In each case, the interposer layers may serve to protect the first and second frame bodies 36 and 56 but would have surfaces that complement the shape of the second optical sighting element, the second surface 603, the mounting surface 604 and the mounting surface 360.

Figure 7:
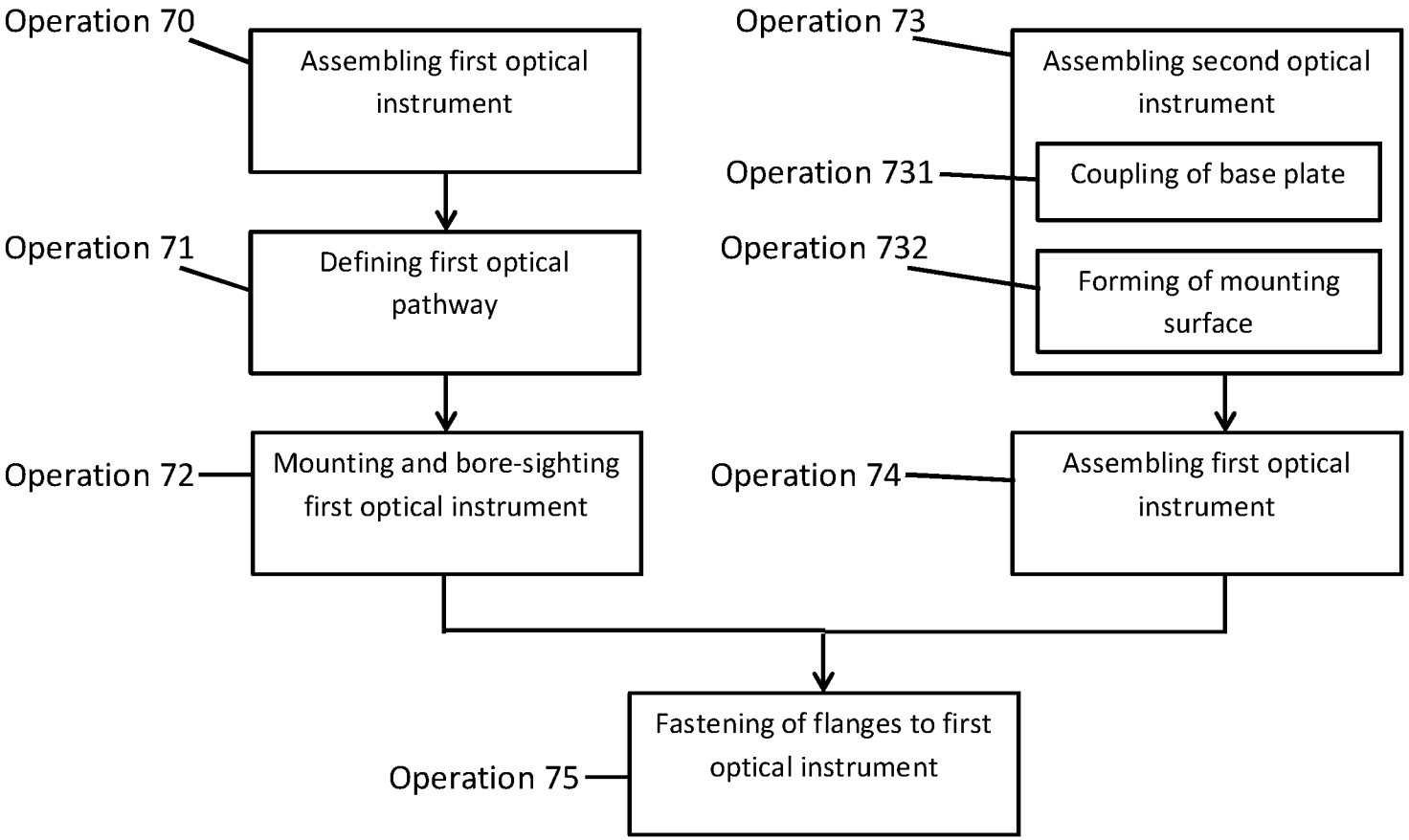
FIG. 7 is a flow diagram illustrating a method of assembling the sight assembly of FIGS. 2-6 in accordance with embodiments.

With reference to FIG. 7, a method of assembling the sight assembly 10 described above is provided. As shown in FIG. 7, the method includes assembling the first optical instrument 30 (operation 70) to thereby define the first optical pathway 34 (operation 71) and, in some cases, mounting the first optical instrument 30 to the rifle 101 and bore-sighting the first optical instrument 30 with the bore-sights 107 (operation 72). In parallel with operations 70, 71 and 72, the method also includes assembling the second optical instrument 50 (operation 73) to thereby define the second optical pathway 54 (operation 74) and fastening the flanges 61 to the first optical instrument 30 such that the mounting surfaces 604 and 360 abut and the respective first and second optical pathways 34 and 54 become co-aligned (operation 75).

It will be understood that operation 73 includes a coupling of the base plate 601 including the flanges 61 and the mounting surface 604 to the optical sighting element 53 of the second optical instrument 50 (operation 731) and a forming of the mounting surface 604 with a concave curvature or a partially-cylindrical shape with a longitudinal axis co-aligned with the second optical sighting element 53 (operation 732). It will be further understood that operations 73 and 74 may relate to the assembly of multiple second optical instruments 50.

Although the embodiments described above relate to cases where the first and second optical sighting elements 33 and 53 and the first and second optical pathways 34 and 54 become co-aligned with each other, it is to be understood that this configuration is not necessary. In a general sense, with the flanges 61 fastened to the first frame body 36 and the first and second mounting surfaces 360 and 604 abutting, the first and second optical sighting elements 33 and 53 and the first and second optical pathways 34 and 54 respectively become co-aligned with first and second target lines. These first and second target lines may be parallel with one another as in the embodiments described above or, in accordance with alternative embodiments and with reference to FIGS. 8 and 9, transversely oriented with respect to one another.

Figure 8:
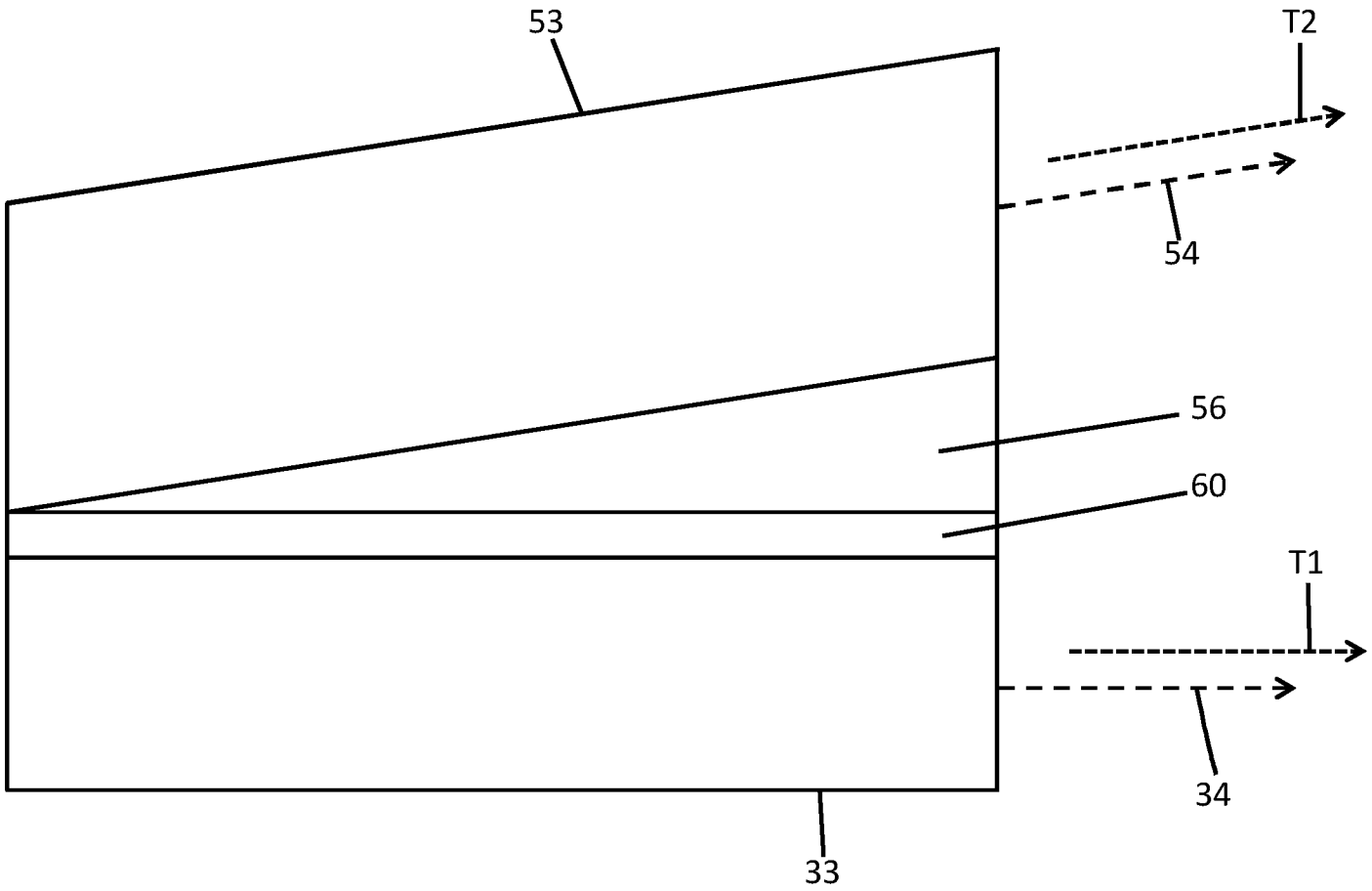
FIG. 8 is a schematic side view of a sight assembly in accordance with alternative embodiments.
Figure 9:
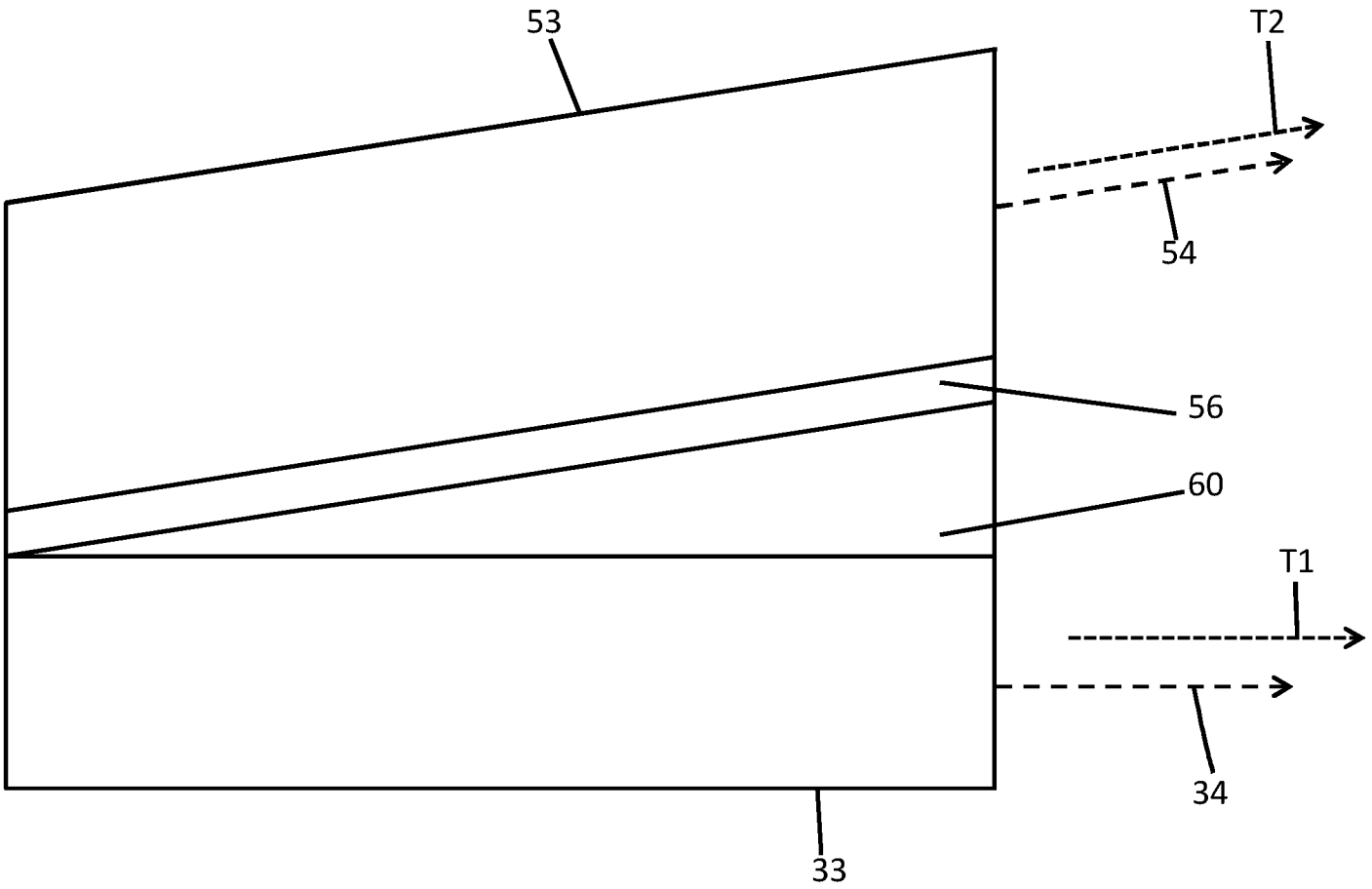
FIG. 9 is a schematic side view of a sight assembly in accordance with alternative embodiments.

As shown in FIGS. 8 and 9, the target lines T1 and T2 are provided and are transversely oriented with respect to one another by a given cant angle. By virtue of various alternative configurations such as clocking elements in the mounting features 57, a cantilevering of the second frame body 56 (see FIG. 8) and/or a cantilevering of the base plate 60 (see FIG. 9), the first optical sighting element 33 and the first optical pathway 34 can be co-aligned and parallel with the first target line T1 while the second optical sighting element 53 and the second optical pathway 54 can be co-aligned and parallel with and the second target line T2. This may be particularly useful for a weapon capable of firing rounds with significantly different ballistic profiles or specific engagement ranges.

In accordance with still further embodiments, it is to be understood that the embodiments described herein are not limited optically by wavelength. Indeed, the first and second optical instruments 30 and 50 may be usable with visible light, Infrared (IR), thermal vision, enhanced night vision, discreet band widths (such as designator lasers), etc. In addition, although the embodiments described above relate to cases in which two optical instruments are employed, multiple additional optical instruments can be formed into a sight assembly 10.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The flow diagrams depicted herein are just one example. There may be many variations to this diagram or the steps (or operations) described therein without departing from the spirit of the invention. For instance, the steps may be performed in a differing order or steps may be added, deleted or modified. All of these variations are considered a part of the claimed invention.

While the embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A close quarters battlefield (CQB) sight, comprising:

an optical sighting element; and a base plate to which the optical sighting element is integrally coupled, the base plate comprising a flange and a mounting surface formed to complement a mounting surface of another optical sighting element, the flange being configured to be fastened to the another optical sighting element such that the mounting surfaces abut and the optical sighting elements become co-aligned, wherein the optical sighting element, the base plate and the flange have no moving parts for boresight correction.

2. The CQB sight according to claim 1, wherein the optical sighting elements each comprise a frame and an optical sight supported within the frame.

3. The CQB sight according to claim 1, wherein the optical sighting elements have first and second differing ranges, respectively.

4. The CQB sight according to claim 1, wherein the flange is provided as first and second flanges at first and second sides of the base plate, respectively.

5. The CQB sight according to claim 4, wherein:

the mounting surfaces comprise concave and convex curvatures, the first and second flanges extend as transverse curved protrusions in opposite directions laterally outwardly from the mounting surface with the concave curvature to extend a reach of the mounting surface with the concave curvature laterally outwardly, and the first and second flanges are configured to be fastened to corresponding fasteners of the another optical sighting element.

6. The CQB sight according to claim 1, wherein, with the flange fastened to the another optical sighting element and the mounting surfaces abutting, the optical sighting elements respectively co-align with transverse target lines.

7. A sight assembly, comprising:

a first optical instrument comprising an optical sighting element formed to define an optical pathway and a mounting surface; and a second optical instrument comprising:

an optical sighting element formed to define an optical pathway; and base plate to which the optical sighting element of the second optical instrument is integrally coupled, the base plate comprising a flange and a mounting surface formed to complement the mounting surface of the first optical instrument, the flange being configured to be fastened to the first optical instrument such that the mounting surfaces abut and the optical pathways become co-aligned, wherein the second optical instrument has no moving parts for boresight correction.

8. The sight assembly according to claim 7, wherein the first optical instrument comprises a telescopic sight mountable to and bore-sightable with a weapon.

9. The sight assembly according to claim 7, wherein the optical sighting elements each comprise a frame and an optical sight supported within the frame.

10. The sight assembly according to claim 7, wherein the optical pathways have differing ranges.

11. The sight assembly according to claim 7, wherein the flange is provided as first and second flanges at first and second sides of the base plate, respectively.

12. The sight assembly according to claim 11, wherein:

the mounting surface of the second optical instrument comprises a concave curvature, the first and second flanges extend as transverse curved protrusions in opposite directions laterally outwardly from the mounting surface of the second optical instrument to extend a reach of the mounting surface of the second optical instrument laterally outwardly, and the first and second flanges are configured to be fastened to corresponding fasteners of the first optical instrument.

13. The sight assembly according to claim 7, wherein, with the flange fastened to first optical instrument and the mounting surfaces abutting, the optical pathways respectively co-align with transverse target lines.

14. A method of assembling a sight assembly, the method comprising:

defining respective optical pathways through optical sighting elements of first and second optical instruments;

coupling, to the optical sighting element of the second optical instrument, a base plate comprising a flange and a mounting surface formed to complement a mounting surface of the first optical instrument; and fastening the flange to the first optical instrument such that the mounting surfaces abut and the respective optical pathways become co-aligned with each other or, respectively, with transverse target lines, wherein the fastening of the flange to the first optical instrument achieves co-alignment of the respective optical pathways without boresight correction of the second optical instrument.

15. The method according to claim 14, further comprising:

mounting the first optical instrument to a weapon; and bore-sighting the first optical instrument.

16. The method according to claim 14, wherein the respective optical pathways have differing ranges.

17. The method according to claim 14, further comprising forming the mounting surface of the second optical instrument with a concave curvature.

* * * * *